United States Patent [19]

Palka

[11] 4,134,625

[45] Jan. 16, 1979

[54] BATHROOM CABINET

[75] Inventor: James J. Palka, Arlington Heights, Ill.

[73] Assignee: General Bathroom Products Inc., Elk Grove Village, Ill.

[21] Appl. No.: 869,846

[22] Filed: Jan. 16, 1978

[51] Int. Cl.[2] ..... A47B 67/00

[52] U.S. Cl. ..... 312/206; 312/224; 312/227; 312/245

[58] Field of Search ..... 312/206, 245, 140, 224, 312/226, 227, 293, 138 R, 257 A; 49/463

[56] References Cited

U.S. PATENT DOCUMENTS

| | | | |
|---|---|---|---|
| 2,678,252 | 5/1954 | Swearingen | 312/227 |
| 2,738,049 | 3/1956 | Shepherd | 312/138 R |
| 2,987,782 | 6/1961 | Kurowski | 49/463 |
| 3,298,764 | 1/1967 | Goldfarb | 312/227 |
| 3,628,845 | 12/1971 | Grimm | 312/138 R |
| 3,758,183 | 9/1973 | Steinkamp et al. | 312/245 |
| 3,807,824 | 4/1974 | Hayes | 312/245 |
| 4,023,872 | 5/1977 | Palka et al. | 312/226 |
| 4,076,350 | 2/1978 | Crist | 312/245 |

FOREIGN PATENT DOCUMENTS

| | | | |
|---|---|---|---|
| 1554195 | 11/1969 | Fed. Rep. of Germany | 312/224 |

*Primary Examiner*—Victor N. Sakran
*Attorney, Agent, or Firm*—Rummler & Snow

[57] ABSTRACT

An inexpensive bathroom cabinet plastic molded in one piece having integrally formed shelves, with a mirrored door pivotally attached to the cabinet upper and lower walls at one side having upper and lower cooperating pivots.

3 Claims, 8 Drawing Figures

BATHROOM CABINET

BACKGROUND OF THE INVENTION

Plastic molded bathroom cabinets having a mirror are old in the art but these cabinets are expensive to manufacture and sell.

SUMMARY OF THE INVENTION

The main object of this invention is to manufacture and sell an extremely inexpensive bathroom cabinet having integrally formed shelves therein.

Another object is to provide an inexpensive mirrored door for the cabinet pivoted at the one side to the upper and lower walls of the cabinet and readily removable at will by removing one of the pivots for ready cleaning of the interior of the cabinet and the mirror.

DETAILED DESCRIPTION OF THE DRAWINGS

Figure 1:
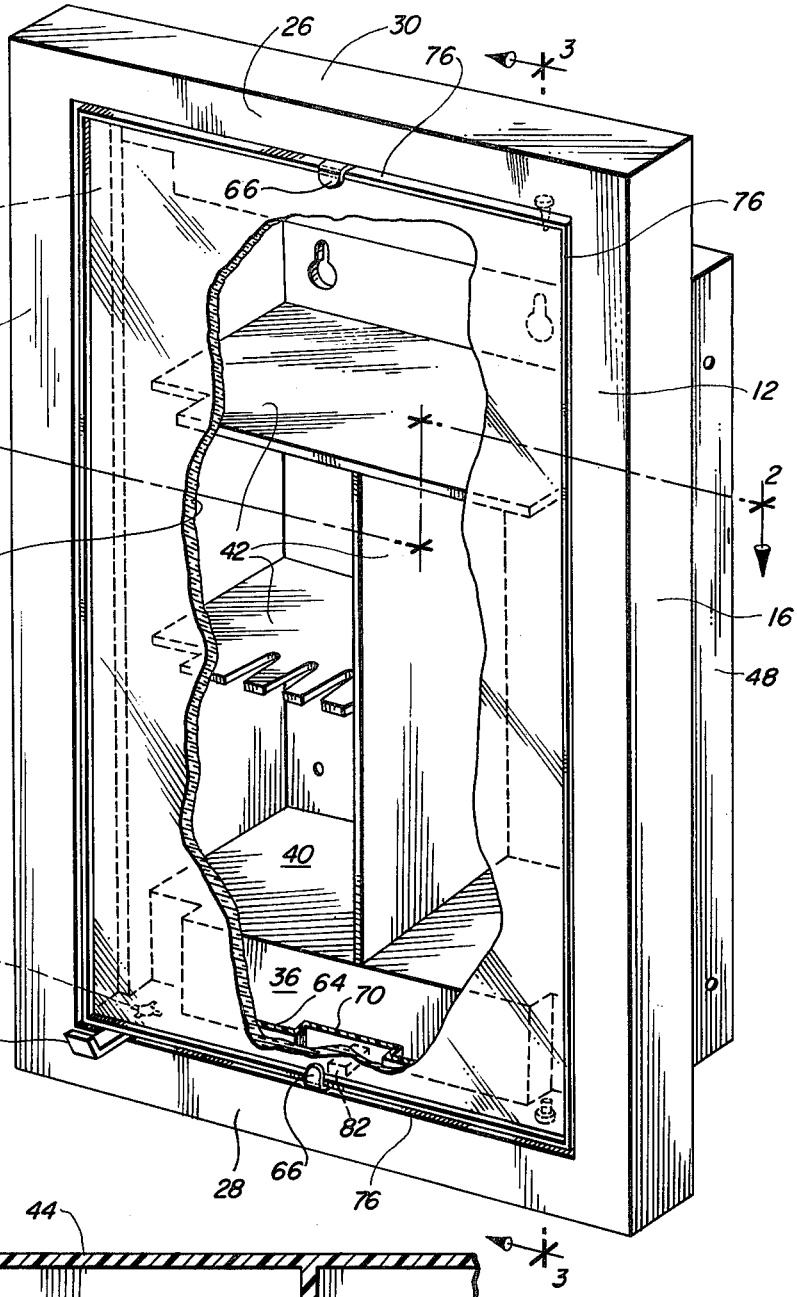
FIG. 1 is a perspective view of the invention with parts broken away.

The cabinet of the present invention is molded of a plastic comprising a front section having pairs of said front walls 10, 12, outer side walls 14, 16 and inner side walls 18, 20, and upper and lower face walls 26, 28 which may be planar as shown in FIG. 1 or ornamented as shown in FIGS. 2 through 5. The front section is also provided with outer top and bottom walls 30, 32 and inner top and bottom walls 31, 33 having thickened portions 35, 37. The front section is also provided with short rear walls 34, 36.

The rear section is offset from the front section and is provided with top wall 38 with its forward edge being integrally secured to the lower end of rear wall 34 while the forward edge of the bottom wall 40 is integrally secured to the upper edge of rear wall 36, and the ends of side walls 38, 40 are integrally secured to the ends of side walls 18, 20.

All the shelves and dividers 42 are integrally formed on and extend forwardly from the rear wall 44 of the second section and their other edges are integral with the side walls 46, 48 or the divider wall 42.

Figure 7:
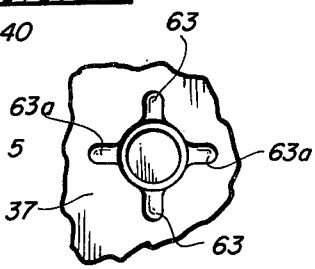
FIG. 7 is an elevational view taken on the lines 7—7 of FIG. 5 showing the grooves.
Figure 6:
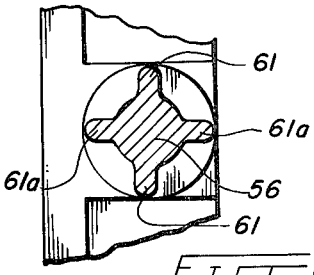
FIG. 6 is an elevational view taken on the lines 6—6 of FIG. 5 of the bottom of the lower pivot.

Mirror pivot perforations or seats 50, 52 in the thickened areas 35, 37, respectively, are aligned to receive removable elongated pivots 54, 56, respectively. The pivot 54 is provided with an enlarged, flanged head 58 and the pivot 56 is provided with a flange 60 extending outwardly of the side wall and located substantially medially from its ends. On the lower face of the flange 60, pairs of half round, right angled bars **61, 61*a* are formed, each spaced 90° from one another, as shown in FIG. 6, to cooperate with aligned grooves 63, 63*a* molded in the upper surface of the enlargement 37 (see FIG. 7**) to cooperate to hold the door open and closed.

The mirror 62 is secured to a backing board 64 of polystyrene and secured thereto by tapes having adhesive on both sides. Retainer clips 66 are also used to insure that the mirror adheres to the backing board 64.

The preformed plastic backing board 64 is provided with vertical side and medial offsets 68, 70, respectively, to reduce the overall weight of the backing board. The side offsets are provided with hollow seats 72 molded therein and a perforation 74 to receive the upper and lower ends, respectively, of pivots 54, 56, respectively. The seats 74 are provided with square in cross-section bores and the upper end 57 of pivot 56 is square shaped in cross-section to seat in the bore of one of the seats 74. Also, the backing board is provided with flanges 76 all around its margins between which the edges of the mirror 62 seat, as seen in FIGS. 2 to 5.

The mirror 62 with its backing board 64 may be removed from the cabinet by raising the upper pivot 54 to remove it from the seat 72, tilting the mirror forwardly and shifting it upwardly, thus freeing the lower end of the mirror from pivot 56. It is replaced the opposite way it was removed. The bars 61 and **61*a* will seat in the grooves 63 and 63*a*, respectively, due to the weight of the mirror and its backing board and retain the mirror in closed position. Thus, since the square in cross-section portion 57 is seated in the square in cross-section seat 74, when the door is opened 90°, the entire pivot 56 will rotate and again, because of the bars 61, 61*a* and their seats 63, 63*a***, will keep the door in open position.

Figure 2:
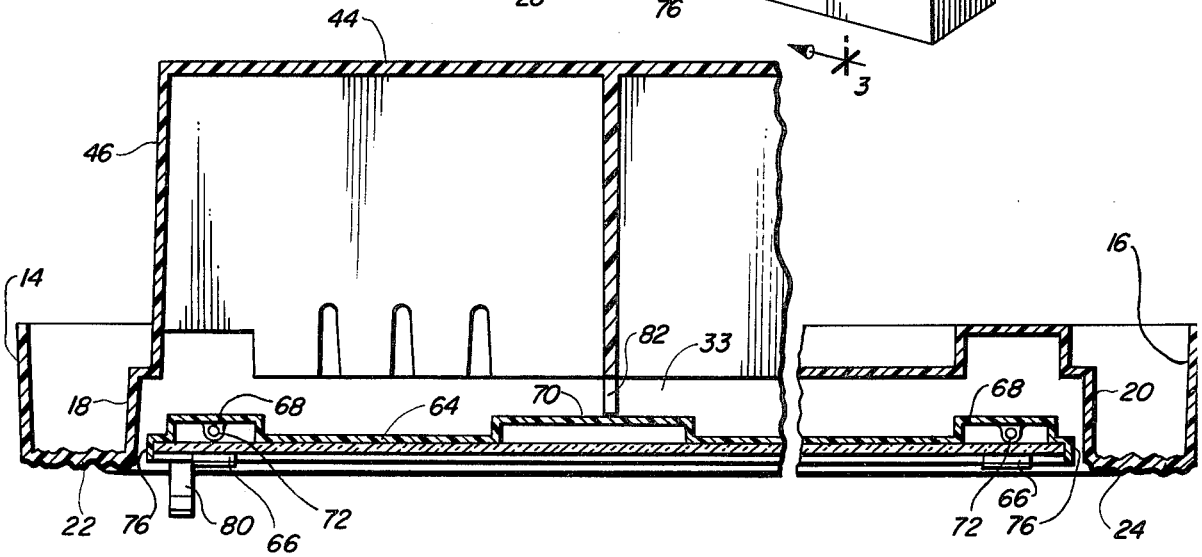
FIG. 2 is a cross-sectional view taken on the lines 2—2 of FIG. 1.
Figure 3:
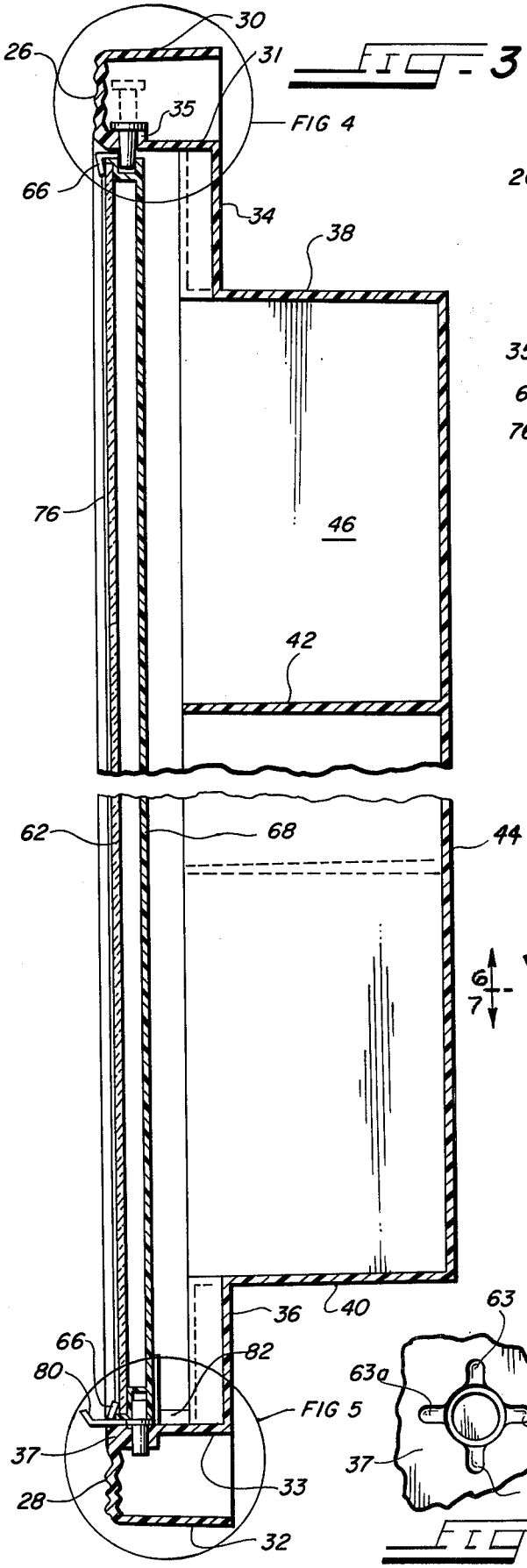
FIG. 3 is a cross-sectional view taken on the lines 3—3 of FIG. 1.
Figure 4:
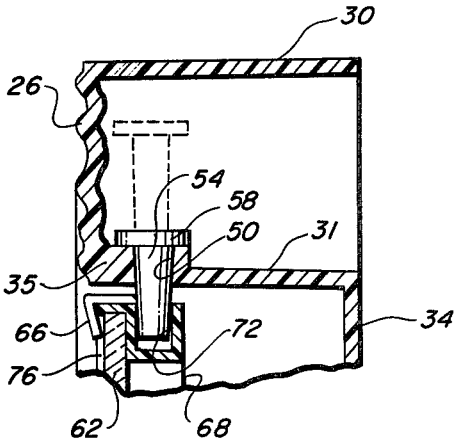
FIG. 4 is a cross-sectional view taken on the upper circle of FIG. 3 and enlarged.
Figure 8:
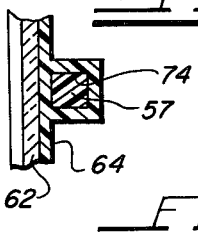
FIG. 8 is a cross-sectional view taken on the lines 8—8 of FIG. 5.
Figure 5:
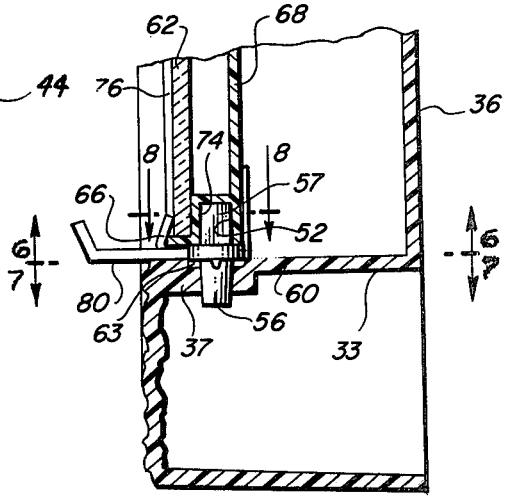
FIG. 5 is a cross-sectional view taken on the lower circle of FIG. 3 and enlarged.

If a left hand door swinging movement is desired, it is to be noted that an appropriate seat **52*a* is incorporated on the left hand side of the backing member 68 on wall 33, as shown in FIG. 2**.

A door pull handle 80 is secured to the lower part of the backing opposite the hinge.

The lowermost shelf formed by the bottom wall 40 of the cabinet appears as a solid member with a deep front wall, which is vertical wall 36, and has a square bar-like member 82 extending forwardly therefrom along the bottom wall 33. The forward end of this member acts as a stop for the mirror-backing member to prevent the door from shifting inwardly beyond the cutouts in closed position.

The front wall 84 and all horizontal shelves 42 are cut away inwardly at their front ends to allow for the opening of the mirror-backing door at the pivoted side edges.

Although but one specific embodiment of this invention is herein shown and described, it will be understood that details of the construction shown may be altered or omitted without departing from the spirit of the invention as defined by the following claims.

I claim:

1. A low cost, fully molded bathroom cabinet comprising a front section and a rear section, the front section having outer side and upper and lower front walls and top and bottom walls, inner top and bottom walls and offset inner spaced rear walls, a pivot seat on one side of said inner top wall and an aligned pivot seat on the inner bottom wall, the rear section being offset from said front section and having a top, bottom, side and rear walls, the forward ends of said top, side and bottom walls being integral with and extending rearwardly from said inner rear walls, integrally formed shelves in the interior of said rear section, a mirrored door for said cabinet comprising a mirror and a backing board therefor, said backing board having offsets therein extending vertically and between the side margins thereof, forwardly extending flanges on the margins of said backing board between which the mirror seats, the upper and lower portions of said backing board having aligned seats therein and at one side thereof, a removable headed pivot pin loosely seated in said inner top wall seat of said first section and said seat upper portion of said backing board, a lower pivot pin having a flange extending outwardly of said pivot and positioned substantially medially of the ends of said lower pivot, said lower pivot seated in said seat in said inner bottom wall and said seat in said lower flange, the flange on said lower pivot positioned between the respective two pivot seats, a handle for said opening in said door positioned on the lower end thereof and on the side opposite said lower pivot.

2. The device according to claim 1 wherein the upper portion of the lower pivot above the flange is square in cross-section and said lower seat in said backing board being square in cross-section to seat said upper portion of said pivot.

3. The device according to claim 2 wherein the lower surface of said pivot flange is provided with integrally formed, half round bars each extending at right angles to an adjacent one, and seats therefor about the pivot seat in the inner bottom wall, whereby when said mirror moves about its pivots, the lower pivot physically also shifts as said door moves, and whereby the door will be retained in its closed and fully open position by said lower pivot.

* * * * *